US007549540B2

(12) United States Patent
Lee et al.

(10) Patent No.: US 7,549,540 B2
(45) Date of Patent: Jun. 23, 2009

(54) AIR-TIGHT RECLOSABLE PROCESSED FOOD CONTAINER

(75) Inventors: Sang Jin Lee, Seoul (KR); Kyoung Sik Jo, Seoul (KR); Gu Hoan Cha, Seoul (KR)

(73) Assignee: CJ Cheiljedang Corporation, Seoul (KR)

( * ) Notice: Subject to any disclaimer, the term of this patent is extended or adjusted under 35 U.S.C. 154(b) by 458 days.

(21) Appl. No.: 11/205,240

(22) Filed: Aug. 15, 2005

(65) Prior Publication Data

US 2006/0032858 A1 Feb. 16, 2006

(30) Foreign Application Priority Data

Aug. 13, 2004 (KR) ..... 10-2004-0063808

(51) Int. Cl.
*B65D 21/02* (2006.01)
*B65D 17/34* (2006.01)
*B65D 41/02* (2006.01)

(52) U.S. Cl. ..... 206/519; 220/359.2; 220/359.4; 220/787

(58) Field of Classification Search ..... 220/359.1, 220/359.2, 359.4, 787, 793; 206/515, 519
See application file for complete search history.

(56) References Cited

U.S. PATENT DOCUMENTS 3,547,338 A * 12/1970 Hemmes ..... 229/123.1
4,689,099 A * 8/1987 Ito et al. ..... 156/69
4,765,463 A * 8/1988 Chanel ..... 206/213.1
(Continued)

FOREIGN PATENT DOCUMENTS

JP 62-109762 5/1987
(Continued)

OTHER PUBLICATIONS

Japanese Office Action with English Translation for JP 2004-339617, 4 pages.

*Primary Examiner*—Anthony D Stashick
*Assistant Examiner*—Niki M Eloshway
(74) *Attorney, Agent, or Firm*—Rothwell, Figg, Ernst & Manbeck

(57) ABSTRACT

Provided is a structure of an air-tight reclosable processed food container in which a lid can be easily opened, can be reclosed for maintaining a remaining food, and can be checked by the user whether it has been opened or not prior to purchasing the food. The air-tight reclosable processed food container, an upper part of which is opened and includes a container body that forms a space with a bottom surface and an container wall and a lid coupled to the container body capable of being opened and closed. The container body includes a container flange formed to extend horizontally along an upper circumference of a container wall and a coupling groove is formed along an upper inner circumference of the container wall, a container leaf formed to extend downward from the container flange, and a container handle formed to extend horizontally from an arbitrary point of the container leaf. The processed food container can maintain a remaining food in a sealed state since it can be sealed air-tight by a coupling groove of the container body and the coupling unit of the lid. Also, a user can easily determine whether the lid has been opened or not prior to purchasing the food since the container handle and the lid handle are heat junctioned.

1 Claim, 6 Drawing Sheets

U.S. PATENT DOCUMENTS

| | | | | |
|---|---|---|---|---|
| 4,834,259 | A * | 5/1989 | Kubis et al. | 220/359.2 |
| 4,844,263 | A * | 7/1989 | Hadtke | 206/508 |
| 4,961,513 | A * | 10/1990 | Gossedge et al. | 220/276 |
| 5,007,231 | A * | 4/1991 | Ingemann | 53/412 |
| 5,125,529 | A * | 6/1992 | Torterotot | 220/270 |
| 6,135,304 | A * | 10/2000 | Wyslotsky | 220/276 |
| 6,889,825 | B2 * | 5/2005 | Ichikawa et al. | 206/5.1 |
| 2002/0125253 | A1 * | 9/2002 | Massey et al. | 220/359.4 |
| 2003/0183636 | A1 * | 10/2003 | Shih | 220/359.1 |

FOREIGN PATENT DOCUMENTS

| | | |
|---|---|---|
| JP | 07017502 | 1/1995 |
| JP | 10-258877 | 9/1998 |
| JP | 2003-231562 A | 8/2003 |
| KR | 100433183 | 5/2006 |

* cited by examiner

PRIOR ART

AIR-TIGHT RECLOSABLE PROCESSED FOOD CONTAINER

BACKGROUND OF THE INVENTION

This application claims the priority of Korean Patent Application No. 10-2004-0063808, filed on Aug. 13, 2004, in the Korean Intellectual Property Office, the disclosure of which is incorporated herein in its entirety by reference.

1. Field of the Invention

The present invention relates to a processed food container capable of reclosing, and more particularly, to an air-tight reclosable processed food container in which the structure is modified so that a lid can be opened easily, a quality of a remained food can be maintained after opening, and a user can check if the lid has been opened or not prior to purchasing.

2. Description of the Related Art

A food container is used for keeping a remained food or when carrying food stuffs for traveling. Especially, when carrying a liquid food stuff, an air-tight sealing structure food container is required for preventing leakage of odor and the liquid.

An example of a sealing structure food container has been disclosed in Korean patent application No. 2003-60740 as depicted in FIG. 1.

The disclosed food container includes a space 2 to which a food is stored, a container body 3, an upper part of which is opened, a lid 6 coupled on the upper part of the container body 3 capable of being closed and opened, and a packing 5 that seals the space 2 by coupling with an edge of the lid 6.

Also, a structure of a coupling leaf 11 in an extended form of the lid 6 for coupling and securing the edge of the lid 6 to the container body 3 is formed on the edge of the lid 6.

This configuration of the container has the advantage of storing a remained food in an air-tight sealed state, but also has the following drawbacks.

First, a packing 5 for sealing the space 2 is required additionally to the container body 3 and the space 2, thereby increasing the number of parts for the container, that is, high manufacturing costs are incurred.

Second, it is impossible for the user to ensure the quality of food because the lid may have been opened prior to purchasing the food container.

Third, the opening operation is complex since a plurality of coupling leafs 11 must be unlocked for opening the lid 6.

Fourth, since heat junction and retort or post-sterilization such as boiling are impossible, the food container cannot be used as a container to store processed food.

SUMMARY OF THE INVENTION

The present invention provides an air-tight reclosable processed food container with a lid that closed with heat junctioned that can be reclosed using the lid that has been opened without using additional packing.

The present invention also provides an air-tight reclosable processed food container in which a lid can be easily monitored to determine if the lid has been opened or not prior to the container being purchased.

The present invention also provides an air-tight reclosable processed food container that can be easily opened when opening the air-tight reclosable processed food container.

According to an aspect of the present invention, there is provided an air-tight reclosable processed food container, an upper part is opened and includes a container body that has a bottom surface and an container wall to form an internal space and a lid coupled to the container body capable of being opened and closed, wherein the container body includes a container flange which extends horizontally along an upper circumference of an container wall and a coupling groove which is formed along an upper inner circumference of the container wall, a container leaf which is formed to extend downward from the container flange, and a container handle which is formed to extend horizontally from an arbitrary point of the container leaf, and the lid includes a lid flange heat junctioned to the container flange by extending horizontally from an end of a coupling unit formed on a lid wall wherein the coupling unit tightly coupled to a coupling groove is formed corresponding to the coupling groove and the lid wall tightly joined to the container wall is formed on an edge of the lid, a lid leaf formed extending downward from the lid flange, and a lid handle, a portion of which is heat junctioned to the container handle by extending from the lid leaf.

The feature of the air-tight reclosable processed food container according to the present invention is that the lid handle and the container handle are separated apart by forming a protrusion unit protruded downward on the center of the lid handle, and the protrusion unit and the container flange are heat junctioned.

Also, the feature of the air-tight reclosable processed food container according to the present invention is that, when stacking the container bodies, the container bodies are maintained apart from each other by a predetermined space by forming a plurality of container supporting stoppers on the container wall of the container body, wherein each of the container supporting stoppers is depressed if it is seen from an inner side and protruded if it is seen from an outer side of the container wall.

Also, the feature of the air-tight reclosable processed food container according to the present invention is that the lid can be easily separated from the container body by forming a plurality of spare grooves on the lid wall that is in tight contacted with the container body, wherein each of the spare grooves is depressed if it is seen from an inner side and is protruded if it is seen from an outer side of the lid wall.

According to the present invention, the processed food container can be reclosed after separating the heat junctioned container flange from the lid flange since the space of the container body can be sealed air tight by the coupling groove and the coupling unit.

BRIEF DESCRIPTION OF THE DRAWINGS

The above and other features and advantages of the present invention will become more apparent by describing in detail exemplary embodiments thereof with reference to the attached drawings in which.

DETAILED DESCRIPTION OF THE INVENTION

Figure 1:
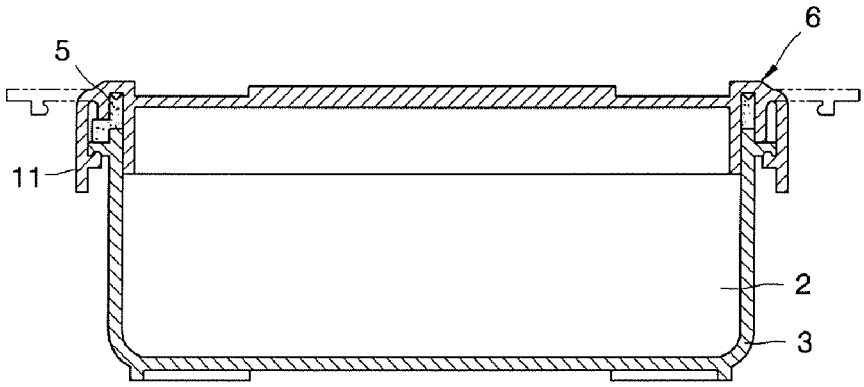
FIG. 1 is a cross-sectional view of a conventional processed food container.

The present invention will now be described more fully with reference to the accompanying drawings in which embodiments of the invention are shown.

The air-tight reclosable processed food container according to the present invention has a structure capable of sealing a space for food, re-closing a lid after it has been opened, and verifying whether the lid has been opened or not prior to purchasing the container.

The air-tight reclosable processed food container according to the present invention can store a liquid food without leaking the liquid since the container can be sealed liquid tight by a lid.

Referring to FIGS. 2 through 4 and 7, an air-tight reclosable processed food container according to the present invention comprises a container body 10 that forms a space 18 which is formed by a bottom surface 11, a container wall 12 and an opened upper part and a lid 20 designed to close and open with respect to the container body 10 by coupling to the container body 10.

The container body 10 comprises a coupling groove 14 formed along an inner circumference of an upper part of the container wall 12, a container flange 13 formed to extend horizontally along an upper circumference of the container wall 12, a container leaf 17 formed to extend downward from the container flange 13, and a container handle 15 formed to extend horizontally from an arbitrary point of the container leaf 17.

Figure 5:
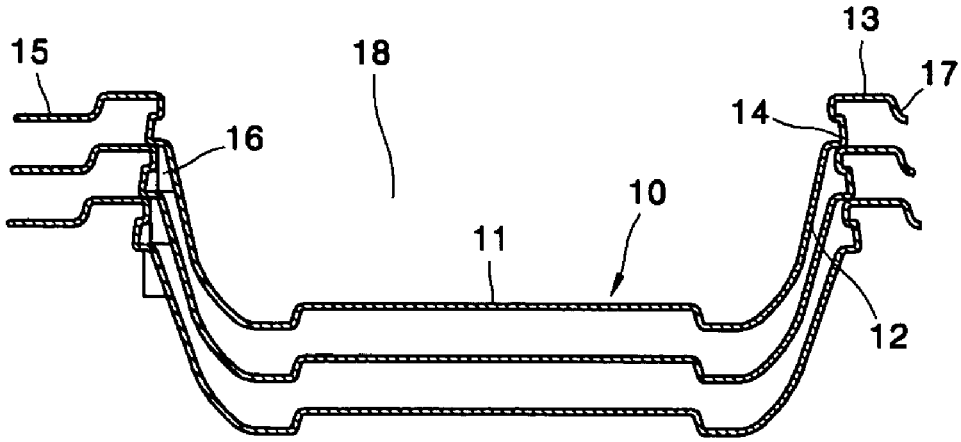
FIG. 5 is a cross-sectional view of a stacking of container bodies.

Also, a plurality of container supporting stoppers 16, each of which is depressed if it is seen from an inner side and is protruded if it is seen from an outer side of the container wall 12, are formed on the container wall 12 of the container body 10. As depicted in FIG. 5, the container supporting stoppers 16 help the container bodies 10 to be easily separated by maintaining a predetermined space between the container bodies 10 when the container bodies 10 are stacked.

The lid 20 has a lid wall 22 that is tightly coupled to the container wall 12 on an edge of the lid 20. A coupling unit 24 that is formed corresponding to the coupling groove 14 and is tightly coupled to the coupling groove 14 is also formed on the lid wall 22.

Also, the lid 20 includes a lid flange 23 which is heat junctioned to the container flange 13 by being extended horizontally from an end of the coupling unit 24, a lid leaf 27 formed to extend downward from the lid flange 23, and a lid handle 25, a portion of which is heat junctioned to the container handle 15 by being extended from the lid leaf 27.

A protrusion unit 25*a* bent downward is formed on the center portion of the lid handle 25, and the protrusion unit 25*a* is heat junctioned to the container handle 15.

Also, the lid handle 25 and an end part of the container handle 15 are separated by the protrusion unit 25*a*, which allows for easy holding of the lid handle 25 for opening the lid 20.

Figure 2:
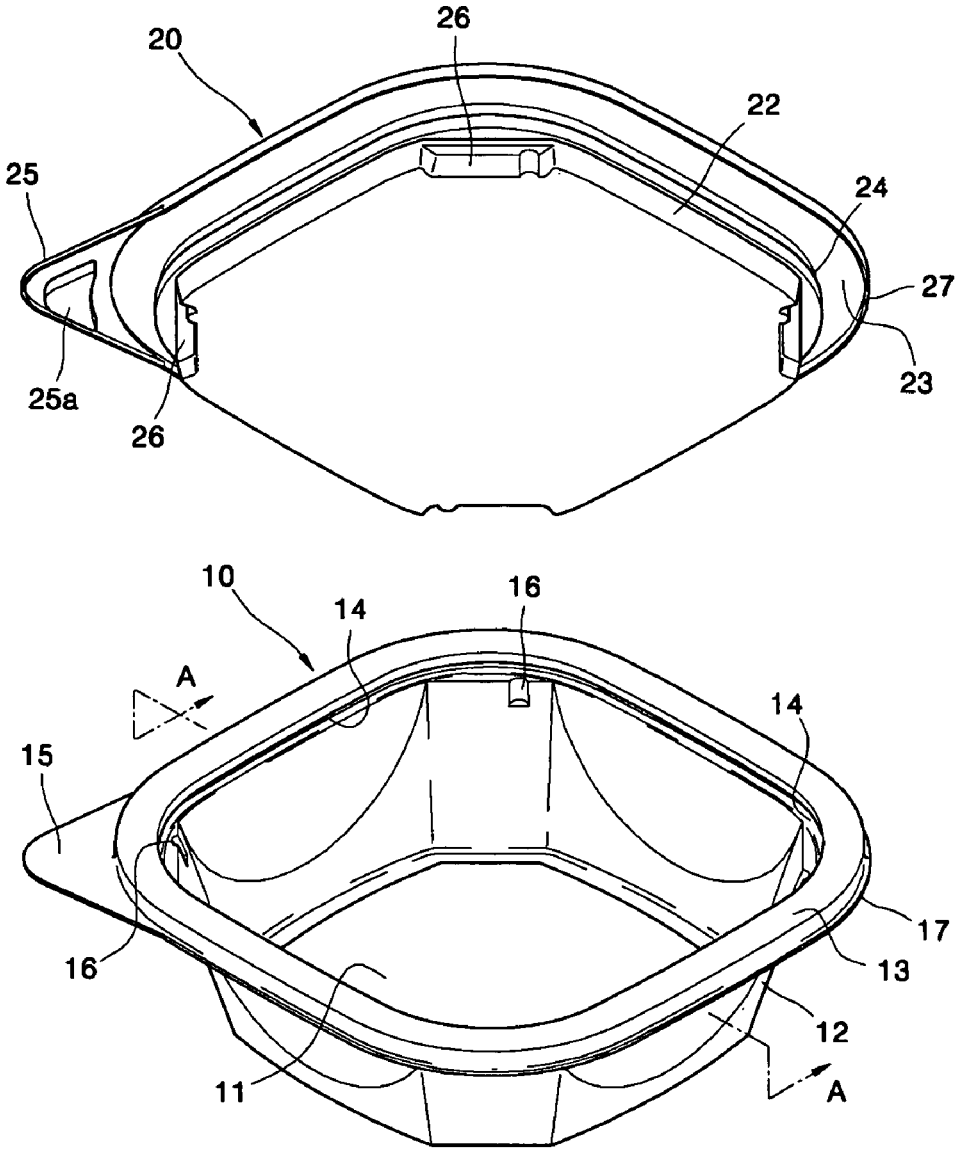
FIG. 2 is a separated perspective view of a processed food container according to the present invention.
Figure 3:
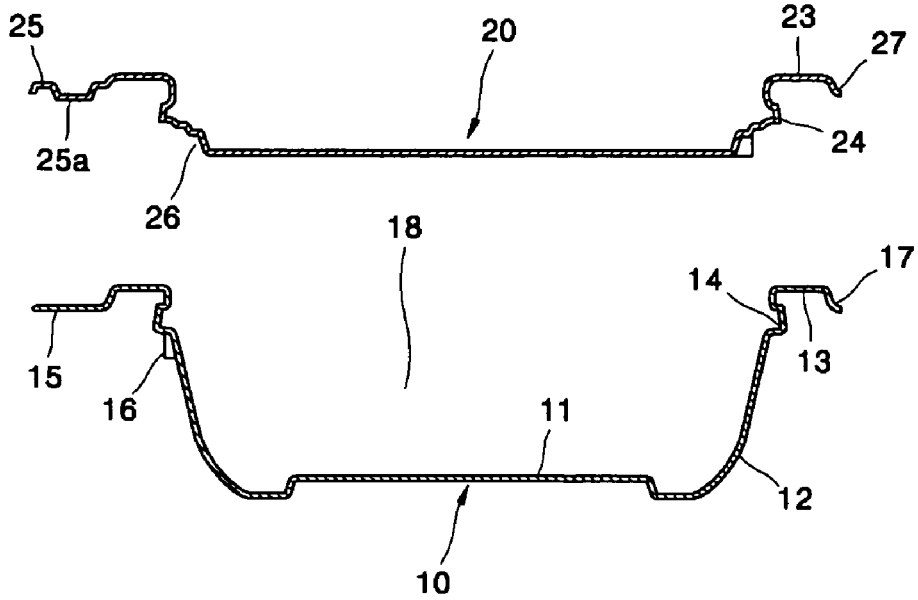
FIG. 3 is a cross-sectional view of the processed food container of FIG. 2.

Referring to FIGS. 2 and 3, a plurality of spare grooves 26 are formed on the lid wall 22 which is in close contact with the container body 10, and each of the spare grooves 26 has a depressed shape if it is seen from an inner side and protruded shape if it is seen from an outer side of the lid wall 22.

Accordingly, the lid 20 can be easily separated from the container body 10 since the container wall 12 of the container body 10 and the lid wall 22 are tightly contacted but separated at the portion of the spare grooves 26.

Figure 6:
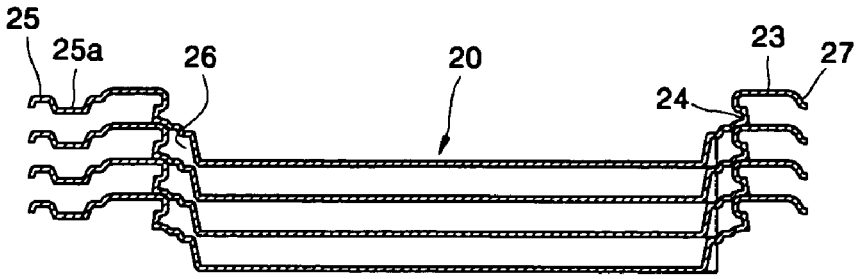
FIG. 6 is a cross-sectional view of a stacking of lids.
Figure 7:
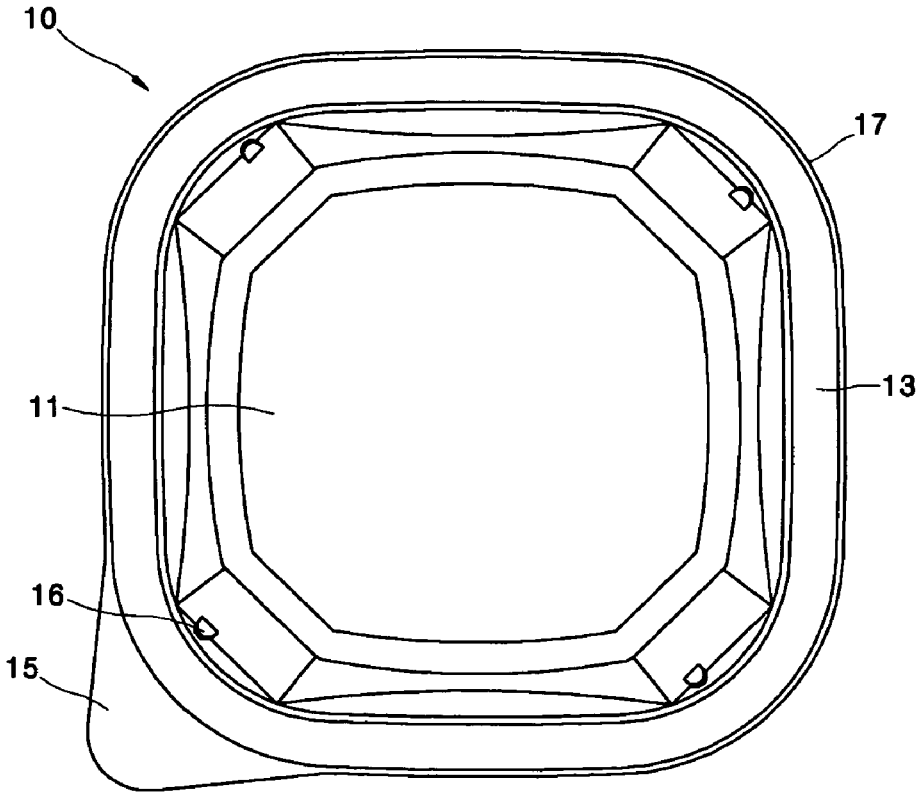
FIG. 7 is a plan view of a container body according to an embodiment of the present invention.

Also, as depicted in FIG. 6, when the lids 20 are stacked, the lids 20 are separated by a predetermined space since the coupling unit 24 of an upper part of the lid 20 is supported by the lid flange 23 of a lower part of the lid 20, thereby separating the lid 20 easily.

Figure 4A:
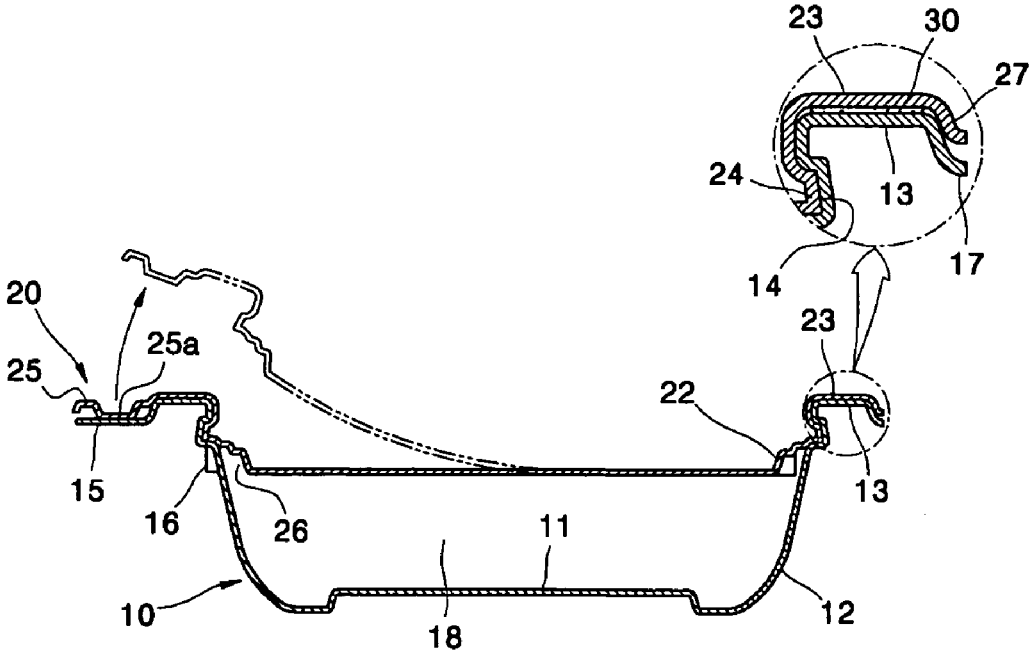
FIG. 4A is a cross-sectional view of a processed food container illustrating an opening operation of the lid.

The container body 10 and the lid 20 are formed of synthesized resin. As depicted in FIG. 4A, a resin film 30 is attached to the container flange 13 and the lid flange 23 so as to allow for easily separation of the heat junctioned portion.

Also, when coupling the lid 20 to the container body 10 by force, the coupling is made by elastic deformation since the circumferential length of the lid wall 22 is substantially greater than the circumferential length of the container body 10, thereby increasing the coupling force.

Figure 4B:
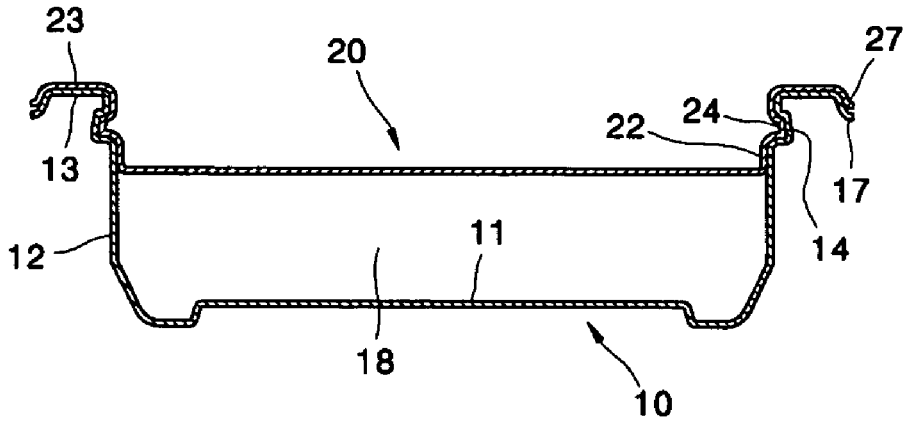
FIG. 4B is a cross-sectional view taken along line A-A in FIG. 2.

As depicted in FIGS. 4A and 4B, in an air-tight reclosable processed food container having the above structure, the container wall 12 of the container body 10 and the lid wall 22 are tightly coupled but the lid wall 22 is separated from the container wall 12 of the container body 10 at the spare grooves 26 portions.

Also, the container body 10 and the lid 20 are in close contact and maintain a sealing state since the coupling unit 24 is elastically coupled to the coupling grove 14, and the lid 20 can be prevented from being removed by an impact when stationary or in transport since the container flange 13 and the lid flange 23, which are facing each other, are heat junctioned.

Also, a user can determine whether the lid 20 has been opened or not prior to purchasing the processed food container since the protrusion unit 25*a* of the lid handle 25 and the container handle 15 are heat junctioned.

In the case of opening the processed food container having the above structure in which the container body 10 and the lid 20 are coupled, as depicted in FIG. 4A, the heat junctioned portion of the handle is separated by forcing the lid handle 25 upward while the container body 10 is held in a fixed position. When forcing the lid 20 upward continually, the coupling unit 24 of the lid 20 is separated from the coupling groove 14 of the container body 10 by the elastic deformation of the lid 20, and then, the lid 20 is completely separated from the container body 10 by being separated the lid wall 22 from the container wall 12.

At this time, the container handle 15 is easily held because the container handle 15 and the lid handle 25 are spaced a part by the protrusion unit 25*a*.

On the other hand, when manufacturing or maintaining a plurality of processed food containers, as depicted in FIG. 5, only the container bodies 10 can be stacked, and as depicted in FIG. 6, only the lids 20 can be stacked in a stacked position. In this case, the stacked container bodies 10 can be easily separated from each other since they are spaced apart by the supporting unit 16 of the container body 10, and the lids 20 can be stably stacked by the base of the coupling unit 24 of the lids 20 contacting the uppermost part of the immediately below the coupling unit 24.

Figure 8:
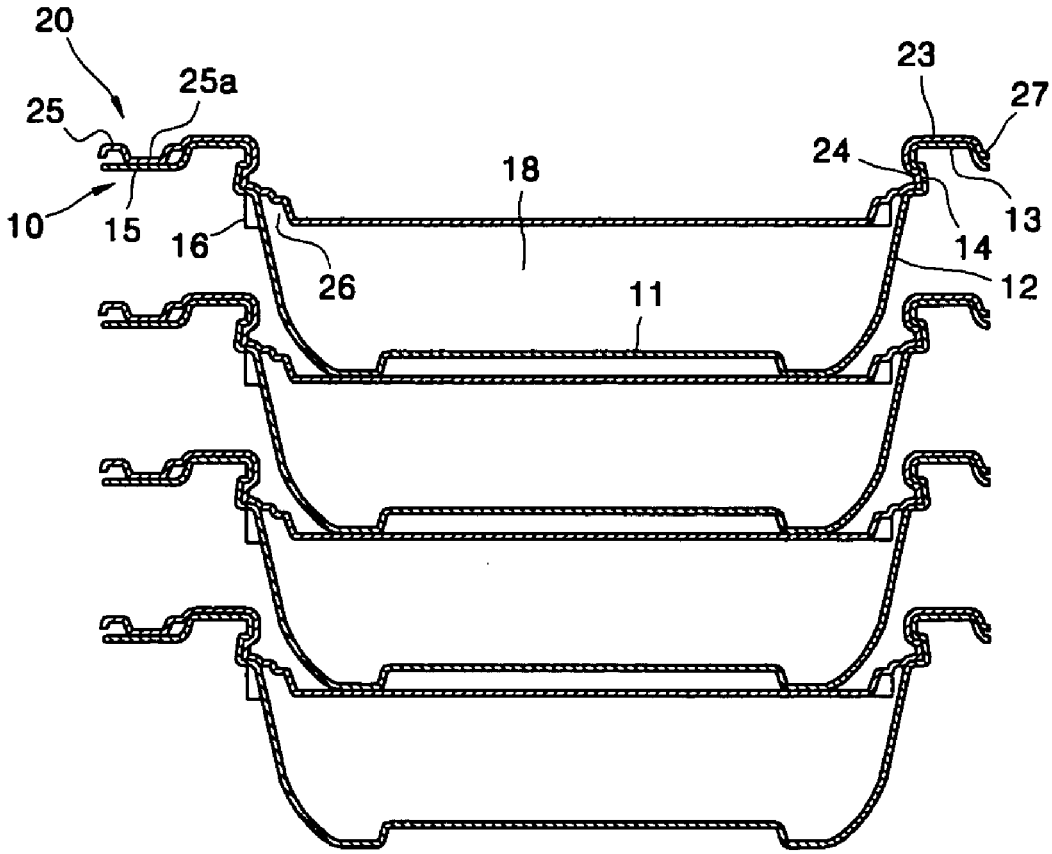
FIG. 8 is a cross-sectional view of a stacking of processed food containers according to the present invention.

Also, when maintaining food in the container body 10, as depicted in FIG. 8, the entire processed food containers can be maintained in a stacked position. At this time, a stable stack of the container bodies 10 on an upper part of the lids 20 can be formed by the depressed part formed by the lid wall 22 of the lid 20.

The present invention has the following advantages.

First, a food can be kept in a sealed state since a sealing of the space can be achieved by the coupling groove of the container body and the coupling unit of the lid.

Second, a user can easily determine whether the lid has been opened or not prior to purchasing the food since the food container has a structure in which the container handle and the lid handle are heat junctioned.

Third, the holding of the lid handle is easily performed since the container handle and the lid handle are spaced apart by a protrusion unit. Therefore, the opening and closing of the lid is easily performed. Also, the sealed processed food container can be easily opened since the container wall of the container body and lid wall are spaced apart by the spare grooves.

Fourth, sterilization after retort is possible by heat juntioning the thermoformed plastic cover to the container, and oxygen is prevented from entering the container thermoformed using a multi-layered sheet. Thus, the processed food includes refrigerating and retort products.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. An air-tight reclosable processed food container, an upper part of which is opened and includes a container body that has a bottom surface and an container wall to form an internal space and a lid coupled to the container body capable of being opened and closed, wherein the container body includes:

a container flange formed to extend horizontally along an upper circumference of a container wall and a coupling groove is formed along an upper inner circumference of the container wall;

a container leaf formed to extend downward from the container flange;

a container handle formed to extend horizontally from an arbitrary point of the container leaf; and the lid includes:

a lid flange heat junctioned to the container flange by extending horizontally from an end of a coupling unit formed on a lid wall wherein the coupling unit tightly coupled to a coupling groove is formed corresponding to the coupling groove and the lid wall tightly coupled to the container wall is formed on an edge of the lid;

a lid leaf formed to extend downward from the lid flange;

a lid handle, a portion of which is heat junctioned to the container handle by extending from the lid leaf;

wherein the lid handle and the container handle are spaced apart from each other by forming a protrusion unit on a center of the lid handle, and wherein the protrusion unit and the container flange are heat junctioned;

wherein the container bodies are maintained apart from each other by a predetermined space when the container bodies are in a stacked position by forming container supporting stoppers on the container wall of the container body wherein each of the container supporting stoppers is depressed if it is seen from an inner side and is protruded if it is seen from an outer side of the container wall; and wherein the lid is easily separated from the container body by forming spare grooves on the lid wall that is tightly contacted to the container body wherein each of the spare grooves is depressed if it is seen from an inner side and is protruded if it is seen from an outer side of the lid wall.

* * * * *